US006564423B2

(12) United States Patent
Sergyeyenko et al.

(10) Patent No.: US 6,564,423 B2
(45) Date of Patent: May 20, 2003

(54) TWO PIECE UPRIGHT HANDLE ASSEMBLY FOR A VACUUM CLEANER SYSTEM

(75) Inventors: Oleksiy P. Sergyeyenko, Brockville (CA); Richard P. Rosa, Kingston (CA); Murray D. Hunter, Kingston (CA); Jacob R. Prosper, Brockville (CA)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/886,957

(22) Filed: Jun. 21, 2001

(65) Prior Publication Data

US 2002/0194698 A1 Dec. 26, 2002

(51) Int. Cl.[7] ..... A47L 9/32; A47L 9/26
(52) U.S. Cl. ..... 15/410; 15/323
(58) Field of Search ..... 15/323, 410; 16/422; 411/402, 409, 401, 400

(56) References Cited

U.S. PATENT DOCUMENTS

| | | | | |
|---|---|---|---|---|
| 1,284,101 A | * | 11/1918 | Hemenway | 411/402 |
| 2,660,457 A | | 11/1953 | Mallon | |
| 2,854,686 A | * | 10/1958 | Hansen | 15/323 |
| 2,923,960 A | | 2/1960 | Davidson | |
| 2,946,071 A | * | 7/1960 | Nilsson | 15/410 |
| 3,065,941 A | | 11/1962 | Loftis | |
| 4,129,920 A | | 12/1978 | Evans et al. | 15/337 |
| 4,155,143 A | * | 5/1979 | Garbe | 15/410 |
| 4,208,942 A | | 6/1980 | Henrit | |
| 4,342,369 A | | 8/1982 | Ransom | |
| 4,463,498 A | | 8/1984 | Everts | |
| 4,505,040 A | | 3/1985 | Everts | |
| 4,621,390 A | | 11/1986 | Hampton et al. | 15/351 |
| 4,662,026 A | | 5/1987 | Sumerau et al. | 15/329 |
| 4,829,675 A | | 5/1989 | Beihoffer | |
| 5,216,779 A | | 6/1993 | Glenn, III | 15/351 |
| 5,230,121 A | | 7/1993 | Blackman | 15/410 |
| 5,257,768 A | | 11/1993 | Juenemann et al. | |
| 5,309,600 A | | 5/1994 | Weaver et al. | 15/328 |
| 5,367,741 A | | 11/1994 | Hampton et al. | 15/323 |
| 5,524,321 A | | 6/1996 | Weaver et al. | 15/329 |
| D374,172 S | | 10/1996 | Frattarola | |
| 5,615,970 A | | 4/1997 | Reekie et al. | |
| D381,143 S | | 7/1997 | Luebbering | |
| 5,664,285 A | | 9/1997 | Melito et al. | 15/352 |
| 5,671,499 A | | 9/1997 | Melito et al. | 15/339 |
| 5,699,586 A | | 12/1997 | Melito et al. | 15/383 |
| 5,713,103 A | * | 2/1998 | Keebler et al. | 15/323 |
| 5,819,364 A | | 10/1998 | Sham | 15/320 |
| 5,868,537 A | * | 2/1999 | Latal et al. | 411/418 |
| 6,012,200 A | | 1/2000 | Murphy et al. | 15/347 |
| D420,898 S | | 2/2000 | Landman | D8/397 |
| 6,108,862 A | | 8/2000 | Frederick et al. | 15/410 |
| 6,317,920 B1 | | 11/2001 | Brickner et al. | 15/334 |
| 6,317,921 B1 | | 11/2001 | Park et al. | 15/334 |
| 6,334,233 B1 | | 1/2002 | Roberts et al. | 15/323 |

FOREIGN PATENT DOCUMENTS

| | | |
|---|---|---|
| DE | 37 088 64 A1 | 9/1988 |
| EP | 0 483 639 A1 | 5/1992 |
| EP | 0 506 307 A1 | 9/1992 |
| EP | 0 612 944 A1 | 8/1994 |

* cited by examiner

*Primary Examiner*—Theresa T. Snider
(74) *Attorney, Agent, or Firm*—Harness, Dickey & Pierce, P.L.C.

(57) ABSTRACT

A vacuum cleaner assembly having a two piece upright handle assembly. The handle assembly includes a recess formed at a lower end of an upper handle component and a neck portion formed at an upper end of a lower handle component. The neck portion can be engaged within the recess such that the two handle components form a rigid assembly. A pair of fastening components are securable within threaded bores formed at the area of intersection of the two handle components to form a rigid, unitary handle assembly. The two piece handle assembly can be assembled by a user without the need for any hand tools and without complicated mechanical assembly procedures. The fastening components also function to support a portion of a power cord when the power cord is wrapped therearound.

13 Claims, 3 Drawing Sheets

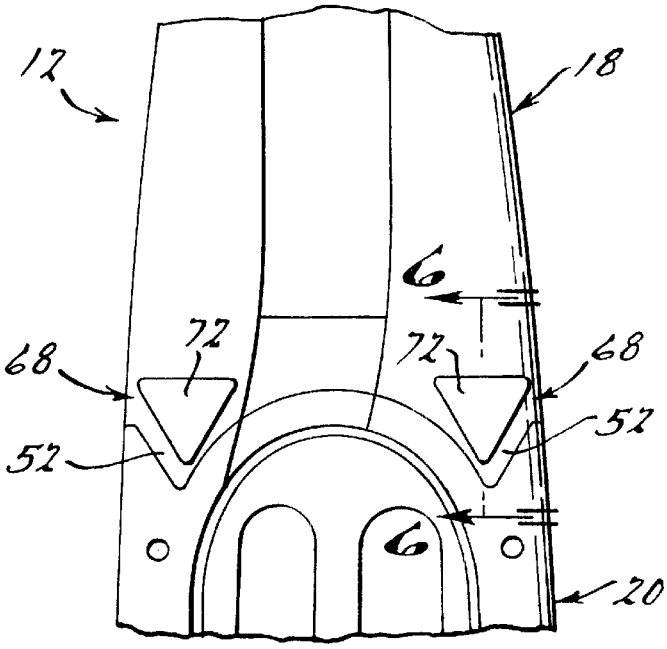
FIG. 5.
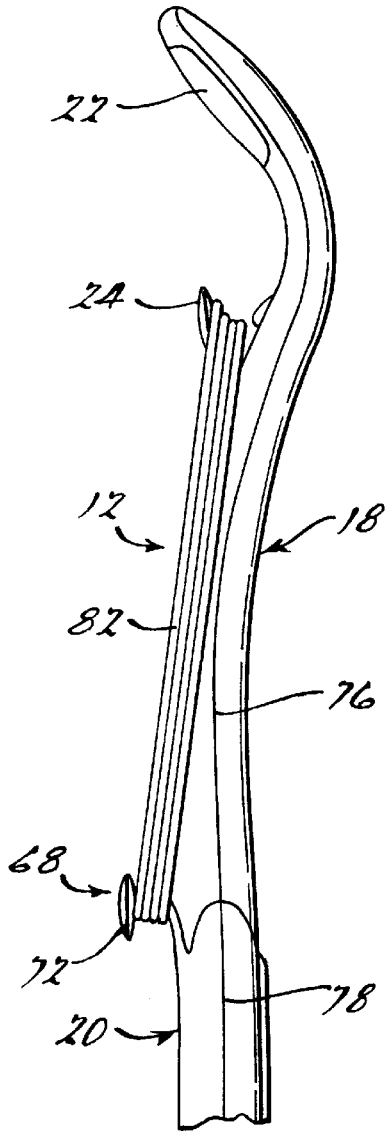
FIG. 7.
FIG. 6.
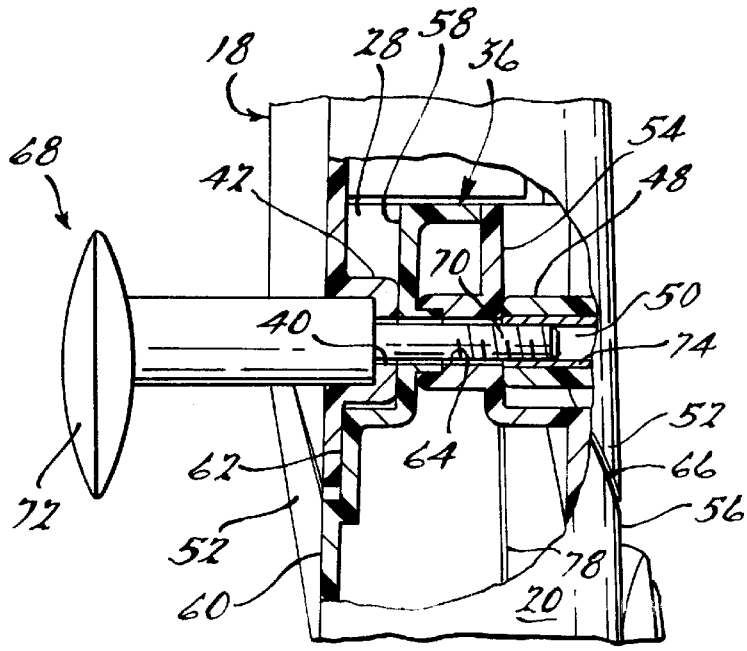

TWO PIECE UPRIGHT HANDLE ASSEMBLY FOR A VACUUM CLEANER SYSTEM

FIELD OF THE INVENTION

This invention relates to vacuum cleaner systems, and more particularly to a vacuum cleaner system having a two piece upright handle assembly which can be quickly assembled by a user without the need for any external tools.

BACKGROUND OF THE INVENTION

Vacuum cleaner systems are used in a wide variety of cleaning applications. One common vacuum cleaner system is of the upright variety, which typically includes an elongated upright handle. The upright handle attaches at its lower end to a vacuum cleaning unit, often termed a "powerhead". One specific type of upright vacuum cleaner is generally known as a "stick vac". A stick vac vacuum cleaner system includes a powerhead which contains essentially all of the major components of a vacuum cleaner such as a fan motor, a fan, a receptacle for containing dust and dirt filtered from an ingested air stream, and often a beater brush. With a stick vac, the upright handle often forms a simple, tube-like member for allowing the user to maneuver the electric powerhead. Alternatively, the typical stick vac handle may include some means for carrying one or more cleaning attachments such as a separate brush, wand or section of vacuum hose.

The stick vac handles typically are of a single piece construction making them relatively difficult to package for shipping purposes. It would therefore be highly desirable to provide an upright handle assembly for a stick vac type upright vacuum cleaner system which allows the upright handle assembly to be shipped in two component pieces, but which still allows a user to quickly assemble the two pieces together without the need for any external tools, and further without the need for complicated assembly procedures.

SUMMARY OF THE INVENTION

The present invention is directed to a two piece handle assembly for an upright vacuum cleaner. The handle assembly comprises a first or upper component and a second or lower component. In one preferred embodiment the upper component includes a recess at its lower end and the lower component includes a neck portion at its upper end. The neck portion is adapted to engage within the recess when the upper end of the lower component is urged into engagement with the lower end of the upper component.

In the preferred embodiments a pair of bores are formed in each of the lower end of the upper handle component and the upper end of the lower handle component. When the two handle components are urged together these bores align to form two securing bores into which threaded fasteners may be inserted. The present invention makes use of threaded fasteners having large, graspable portions which can be easily grasped with a user's hand to apply sufficient torque to tighten the threaded fastener without the need for pliers or like tools. Once the threaded fasteners are installed in each of the securing bores, the assembled handle assembly forms a rigid, unitary structure. An added advantage is that the two threaded fasteners form guideposts around which a power cord can be looped when the vacuum cleaner is not in use.

It is a principal advantage of the present invention that the two handle components of the upright handle assembly can be quickly and easily secured to one another without the need for any external tools, and without the need for complicated and/or extensive mechanical assembly procedures. Thus, when removing the handle assembly of the present invention from its packaging container after purchasing, the user can quickly and easily assembly the upright handle assembly in a matter of minutes. In the event that the vacuum cleaner system needs to be put in storage for a prolonged period of time, the upright handle assembly can be easily disassembled in a matter of minutes to make for more compact storage.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 5 is a rear view of a portion of the handle assembly showing the lower end of the upright handle component secured to the upper end of the lower handle component;

FIG. 6 is a cross sectional side view taken in accordance with section line 6—6 in FIG. 5 showing one of the fastening members securing the lower end of the upper handle component to the upper end of the lower handle component; and FIG. 7 is a side view of the assembled handle assembly illustrating how a portion of a power cord can be looped around the fastening members, as well as around an upper cord retaining post.

DETAILED DESCRIPTION OF THE PREFERRED EMBODIMENTS

Figure 1:
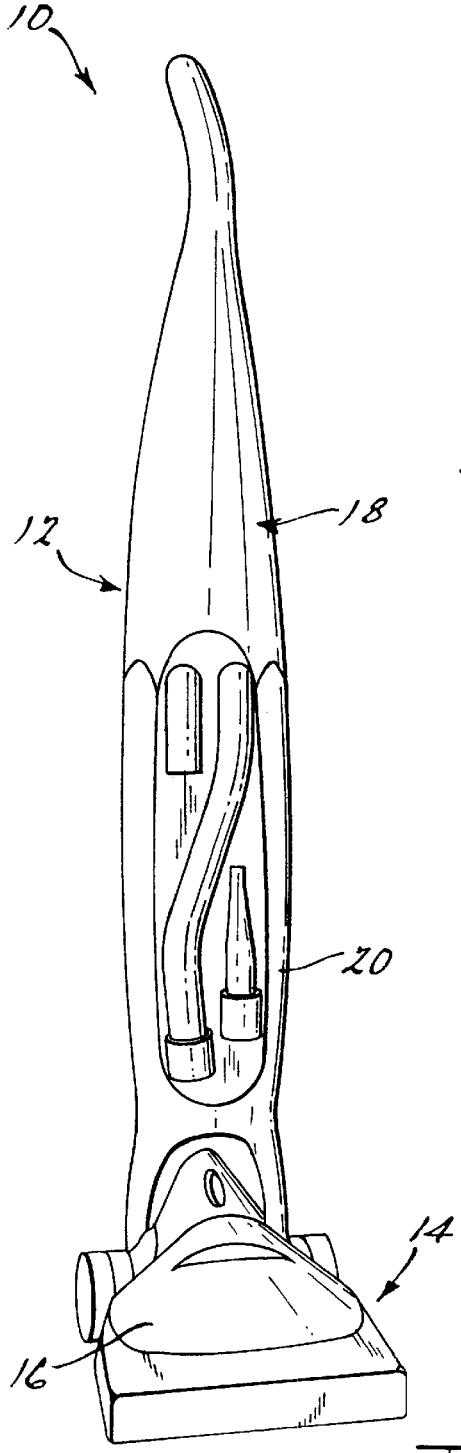
FIG. 1 is a perspective view of a vacuum cleaner system incorporating a two piece handle assembly in accordance with a preferred embodiment of the present invention.

Referring to FIG. 1, there is shown a vacuum cleaner 10 incorporating a handle assembly 12 in accordance with a preferred embodiment of the present invention. The handle assembly 12 is coupled to a powerhead 14. The powerhead 14 includes the typical components such as a fan motor and a fan (not shown) for generating a suction airflow. A removable dirt cup 16 contains dust, dirt and other debris filtered from the suction airflow created by the fan when the vacuum cleaner system 10 is in use. The powerhead 14 can be used in either a floor cleaning mode or in an accessory cleaning mode via suitable accessory cleaning attachments, as is well known in the art.

It will also be appreciated immediately that the handle assembly 12 of the present invention can be used with a wide variety of powerhead constructions. Accordingly, the illustration of powerhead 14 is merely meant to represent one specific type of powerhead with which the handle assembly 12 may be used.

Figure 2:
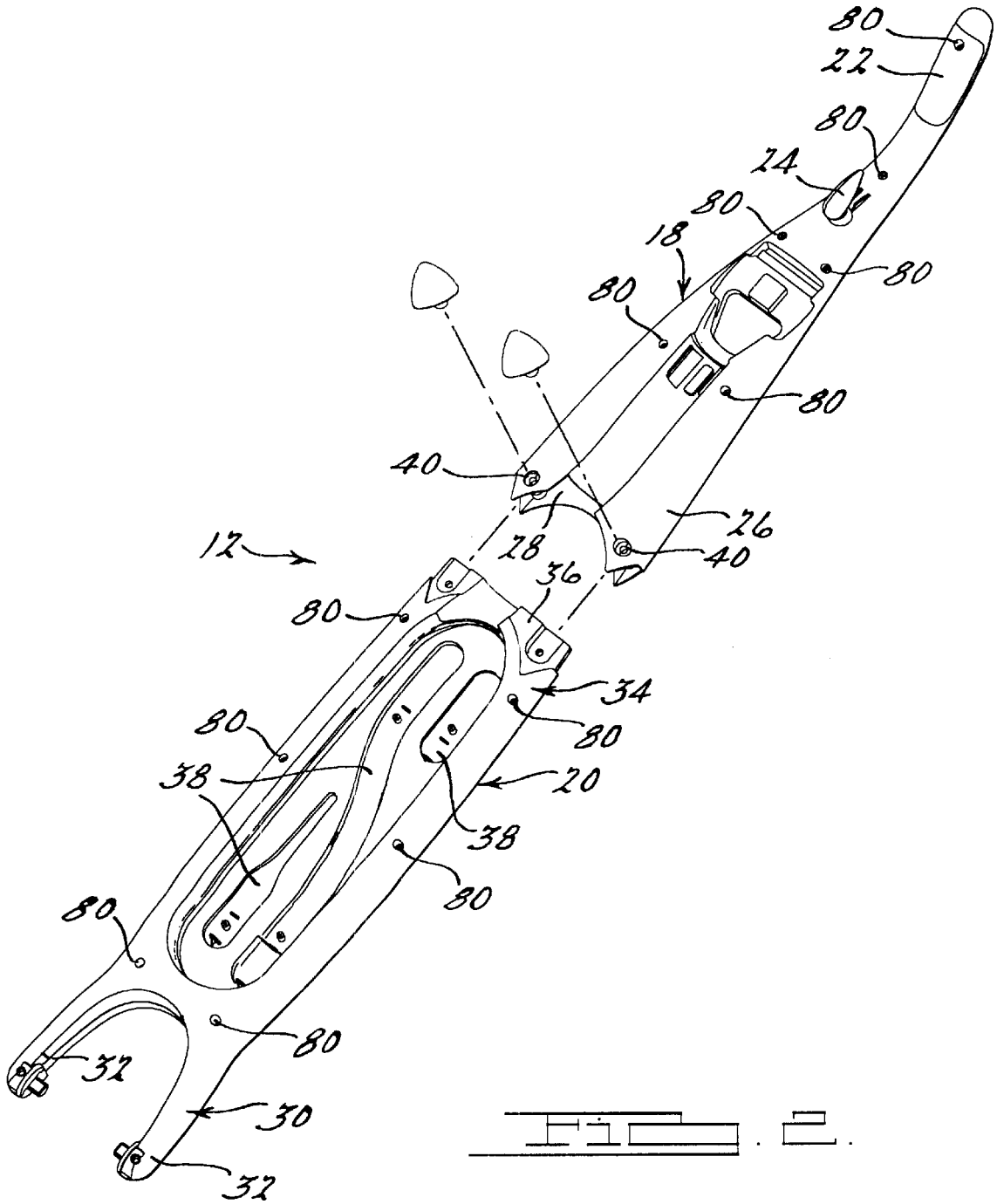
FIG. 2 is an exploded perspective view of the two handle components of the handle assembly of the present invention.

Referring to FIG. 2, the handle assembly 12 includes an upper handle component 18 and a lower handle component 20. The upper handle component 18 includes a graspable handle portion 22, an optional cord retaining post 24, and a lower end 26. The lower end 26 has a recess 28 which is also shown in greater detail in FIG. 3.

The lower handle component 20 includes a lower end 30 which is securable via arms 32 to the powerhead 14. An upper end 34 of the lower handle component 20 includes a neck portion 36. A plurality of molded recesses 38 are used for supporting specific cleaning attachments such as brushes, wands, and a short length of an auxiliary cleaning hose on the handle assembly 12, which may be used when the vacuum cleaner 10 is used in an accessory cleaning mode.

Figure 3:
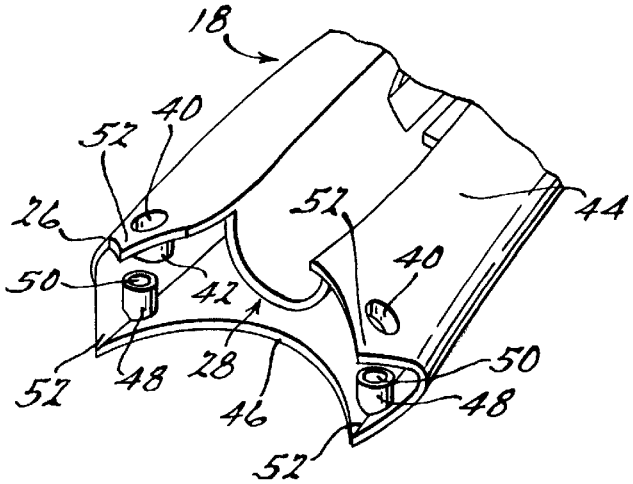
FIG. 3 is an enlarged perspective view of just the lower end portion of the upper handle component.

Referring to FIGS. 3 and 6, the lower end 26 of the upper handle component 18 includes a pair of bores 40 formed within bosses 42, only one boss 42 being visible in FIG. 3. The bores 40 and bosses 42 are formed in a rear wall 44 of the upper handle component 18. A front wall 46 similarly includes a pair of bosses 48 which each include a blind, threaded bore 50. The bosses 48 are spaced apart from bosses 42 by a relatively small distance to allow the neck portion 36 of the lower handle component 20 to be inserted therebetween, as will be explained in greater detail momentarily. Pointed flanges 52 also help to align the lower end 26 of the upper handle component 18 with the upper end 34 of the lower handle component 20 when these two components are being assembled together.

Figure 4:
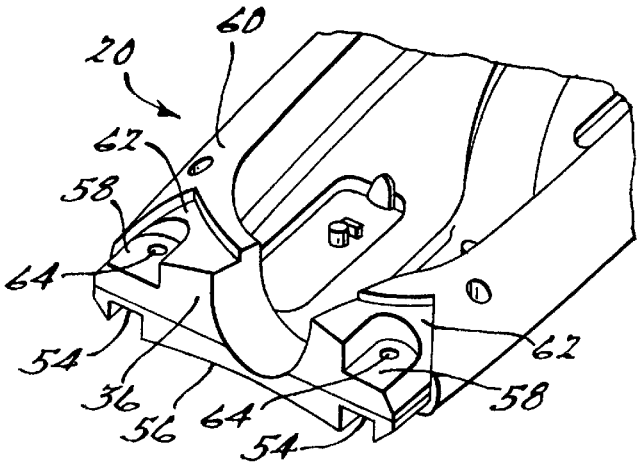
FIG. 4 is an enlarged perspective view of just the upper end of the lower handle component.

Referring now to FIG. 4, the neck portion 36 of the lower handle component 20 can be seen in greater detail. The neck portion 36 includes a first pair of recesses 54 formed on a front wall 56 thereof. A second pair of recesses 58 are formed on a rear wall 60 of the lower handle component 20. Relief portions 62 shaped in accordance with pointed flanges 52 of the upper handle component 18 are also formed in the rear wall 60. Each of the recesses 58 include through bores 64. With brief reference to FIG. 6, the front wall 56 similarly includes identical relief portions 66 (only one of which being visible in FIG. 6) which are aligned over relief portions 62, and which are shaped in accordance with pointed flanges 52 (FIG. 3).

Referring to FIG. 5, the upper handle component 18 is secured to the lower handle component 20 by urging the neck portion 36 of the lower handle component into the recess 28 of the upper handle component. This can be accomplished with a minimal degree of effort by a single person. During this process, the boss portions 42 and 48 engage within the recesses 58 and 54, respectively. The pointed flanges 52 of the upper handle component 18 also slide over relief portions 62 and 66 of the lower handle component 20 which helps to align the boss portions 42 and 48 concentrically with the through bores 64 when the recess 28 and neck portion 36 are urged into mating engagement with one another.

Referring to FIG. 6, final assembly of the handle assembly 12 involves securing a fastening member 68 in each through bore 64. The fastening member 68 includes a threaded stud 70 and an enlarged, manually graspable handle portion 72. In FIG. 2, these handle portions 72 can be seen as being generally triangular in shape. However, it will be appreciated that the triangular shape is shown merely as an example of one shape that allows a user to easily manually grasp the fastening member 68 and apply a sufficient torque thereto with a single hand. Thus, it will be appreciated that a wide variety of other shapes could be employed for the graspable portion 72.

With further reference to FIG. 6, it can be seen that the threaded stud 70 engages within a threaded insert 74 molded into each boss portion 48 and threadably engages therein to maintain the two handle components 18 and 20 rigidly secured to one another. Pointed flanges 52 rest within relief portion 62 and 66 to form a smooth transition on the outer surfaces 44 and 46 of the upper handle component 18 and surfaces 56 and 60 of the lower handle component 20. It will also be appreciated that, for ease of manufacturing the handle assembly 12, each of the upper and lower components 18 and 20, respectively, are preferably formed with a two piece, clamshell like structure, as evidenced by parting lines 76 and 78 in FIG. 7, and held together by suitable fasteners at holes 80 in each of the handle components 18 and 20.

It is a principal advantage of the handle assembly 12 that the design of the recess 28 and neck portion 30 allow the two handle components 18 and 20 to be quickly and easily secured together by a user without the need for any complicated mechanical assembly steps and without the need for any external tools such as pliers, screwdrivers, etc. In the event that the vacuum cleaner 10 is to be placed in storage for a prolonged period of time, the handle assembly 12 can also be disassembled with the same degree of ease.

Referring briefly to FIG. 7, a further advantage of the fastening members 68 is that they allow a section of a power cord 82 to be wrapped therearound and also around the upper retaining post 24 when the vacuum cleaner 10 is not in use. The enlarged graspable portions 72 of each fastening member 68 help to prevent the power cord 82 from slipping off of each of the fastening members once the power cord has been wrapped therearound.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A vacuum cleaner system comprising:

a powerhead unit having an electric motor;

an upright handle secured at its lower end to said powerhead for enabling a user to maneuver said powerhead about a surface to be cleaned;

said upright handle having a first component and a second component adapted to be interlocked to one another to form said upright handle;

at least one fastening member having a graspable portion for enabling a user to install said fastening member through said first and second components to thereby prevent said components from being separated; and wherein said fastening member functions as a power cord supporting apparatus to allow a portion of an electrical cord associated with said powerhead to be wrapped therearound.

2. The vacuum cleaner system of claim 1, wherein each of said first and second components have a bore, said bores being placed in alignment when said first and second components are to be interlocked to one another to cooperatively receive a portion of said fastening member.

3. The vacuum cleaner system of claim 1, wherein one of said first and second components includes a recess formed at a lower end thereof, and the other one of said components includes a neck portion formed at an upper end thereof, said neck portion being received in said recess to form said interlocked engagement.

4. A vacuum cleaner system comprising:

a powerhead unit having an electric motor;

an upright handle secured at its lower end to said powerhead for enabling a user to maneuver said powerhead about a surface to be cleaned;

said upright handle having a first component and a second component adapted to be secured to one another to form said upright handle;

said first component having a bore formed in a boss and said second component having a bore formed in a boss recess, said bore filling within said boss recess such that said bores are placed in alignment to form a securing bore when said first and second components are secured to one another; and at least one manually graspable fastening member having an end portion engageable with said securing bore to prevent said first and second components from being separated, said graspable fastening member having an enlarged head portion allowing a user to easily grasp the fastening member and to thereby secure said components to one another without the need for external hand tools, and to help retain a power cord of said vacuum cleaner system wound therearound.

5. The vacuum cleaner system of claim 4, wherein at least one of said bores comprises a threaded bore; and wherein said end portion of said graspable fastening member comprises a threaded end portion.

6. The vacuum cleaner system of claim 4, wherein said first component includes a recess and said second component includes a neck portion, said neck portion being adapted to interengage with said recess when said first and second components are urged into engagement with one another.

7. A vacuum cleaner system comprising:

a powerhead unit having an electric motor;

an upright handle secured at its lower end to said powerhead for enabling a user to maneuver said powerhead about a surface to be cleaned;

said upright handle having a first component and a second component adapted to be secured to one another to form said upright handle;

said first component having a recess;

said second component having a neck portion, said neck portion being adapted to engage said recess such that said components form a unitary structure;

said first component having a pair of bores formed within a pair of bosses and said second component having a bore formed between a pair of boss recesses, said pair of bosses fitting within said pair of boss recesses such that said bore of said second component is placed in alignment between said pair of bores of said first component to form a securing bore when said first and second components are secured to one another; and at least one graspable fastening member having an end portion engageable with said securing bore to prevent said first and second components from being separated; and said one graspable fastening member operating as a power cord guide member around which a portion of a power cord of said vacuum cleaner system may be wound.

8. The vacuum cleaner system of claim 7, wherein said graspable fastening member comprises a triangular shape.

9. The vacuum cleaner system of claim 7, wherein said end portion of said graspable fastening member comprises a threaded portion, and wherein said securing bore comprises a threaded portion.

10. A two piece handle assembly for a tool to enable easier packaging and storage of said tool, said two piece handle assembly enabling a user to manipulate and maneuver said tool, said two piece handle assembly comprising:

a first handle portion having a recess and a boss;

a second handle portion having a neck portion and a boss recess, said neck portion adapted to engage with said recess of said first handle portion such that said portions are interengaged to form an assembled, unitary handle component, and said boss recess adapted to engage with said boss of said first handle portion, said boss and said boss recess cooperating to add rigidity to said assembled, unitary handle assembly;

each of said handle portions having a bore which align when said handle portions are secured to one another, to thereby form a securing bore;

a graspable fastening member engageable with said securing bore to lock said handle portions secured to one another without the use of external tools; and said graspable fastening member comprising a portion for enabling a portion of a power cord associated with said tool to be wrapped therearound.

11. The two piece handle assembly of claim 10, wherein said graspable fastening member comprises a head portion having a triangular shape.

12. The two piece handle assembly of claim 10, wherein said securing bore includes a threaded portion, and wherein said graspable fastening member includes a threaded portion which engages with said threaded portion of said securing bore when said graspable fastening member is secured in said securing bore.

13. A method for assembling a handle assembly for an upright vacuum cleaner having an electric powerhead, said method comprising the steps of:

providing a first upright handle portion having a first interlocking structure;

providing a second upright handle portion having a second interlocking structure;

urging said handle portions together such that said interlocking structures interengage to form a single, upright handle assembly;

using a portion of a manually graspable fastening member to secure said upright handle portions together without the use of an external tool; and using a portion of said fastening member to enable a power cord of said vacuum cleaner to be wrapped therearound and thus supported by said fastening member.

* * * * *

UNITED STATES PATENT AND TRADEMARK OFFICE

CERTIFICATE OF CORRECTION

PATENT NO. : 6,564,423 B2
DATED : May 20, 2003
INVENTOR(S) : Oleksiy P. Sergyeyenko et al.

It is certified that error appears in the above-identified patent and that said Letters Patent is hereby corrected as shown below:

Title page,
Item [56], References Cited, FOREIGN PATENT DOCUMENTS, insert
-- PCT WO 94/17716 8/1994 --.

Column 5,
Line 12, "filling" should be -- fitting --.

Signed and Sealed this

Twenty-first Day of October, 2003

JAMES E. ROGAN
*Director of the United States Patent and Trademark Office*